US007527110B2

(12) United States Patent
Hall et al.

(10) Patent No.: US 7,527,110 B2
(45) **Date of Patent: *May 5, 2009**

(54) PERCUSSIVE DRILL BIT

(76) Inventors: David R. Hall, 2185 S. Larson Pkwy., Provo, UT (US) 84606; Ronald Crockett, 2185 S. Larson Pkwy., Provo, UT (US) 84606; Joe Fox, 2185 S. Larson Pkwy., Provo, UT (US) 84606; John Bailey, 2185 S. Larson Pkwy., Provo, UT (US) 84606

( * ) Notice: Subject to any disclaimer, the term of this patent is extended or adjusted under 35 U.S.C. 154(b) by 73 days.

This patent is subject to a terminal disclaimer.

(21) Appl. No.: 11/549,513

(22) Filed: Oct. 13, 2006

(65) Prior Publication Data

US 2008/0087473 A1 Apr. 17, 2008

(51) Int. Cl.
*E21B 10/36* (2006.01)

(52) U.S. Cl. ..... 175/420.2; 175/415

(58) Field of Classification Search ..... 175/415, 175/414, 417, 420.1, 420.2
See application file for complete search history.

(56) References Cited

U.S. PATENT DOCUMENTS

| | | | |
|---|---|---|---|
| 465,103 | A | 12/1891 | Wegner |
| 616,118 | A | 12/1898 | Kunhe |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |
| 1,460,671 | A | 7/1923 | Hebsacker |
| 1,544,757 | A | 7/1925 | Hufford |
| 1,821,474 | A | 9/1931 | Mercer |
| 1,879,177 | A | 9/1932 | Gault |
| 2,054,255 | A | 9/1936 | Howard |
| 2,064,255 | A | 12/1936 | Garfield |
| 2,169,223 | A | 8/1939 | Christian |
| 2,218,130 | A | 10/1940 | Court |
| 2,320,136 | A | 5/1943 | Kammerer |
| 2,466,991 | A | 4/1949 | Kammerer |
| 2,540,464 | A | 2/1951 | Stokes |
| 2,544,036 | A | 3/1951 | Kammerer |
| 2,755,071 | A | 7/1956 | Kammerer |
| 2,776,819 | A | 1/1957 | Brown |
| 2,819,043 | A | 1/1958 | Henderson |
| 2,838,284 | A | 6/1958 | Austin |
| 2,894,722 | A | 7/1959 | Buttolph |
| 2,901,223 | A | 8/1959 | Scott |
| 2,963,102 | A | 12/1960 | Smith |
| 3,135,341 | A | 6/1964 | Ritter |
| 3,294,186 | A | 12/1966 | Buell |
| 3,301,339 | A | 1/1967 | Pennebaker |
| 3,379,264 | A | 4/1968 | Cox |

(Continued)

*Primary Examiner*—David J Bagnell
*Assistant Examiner*—Cathleen R Hutchins
(74) *Attorney, Agent, or Firm*—Tyson J. Wilde

(57) ABSTRACT

A percussive drill bit has a working face opposite a shank end. The working face has a central jack insert and a plurality of peripheral inserts extending from the working face. The ends of the plurality of the peripheral inserts form an impacting plane. The central jack insert is disposed within a recessed portion of the working face and has an end extending between the working face and the impacting plane.

21 Claims, 12 Drawing Sheets

U.S. PATENT DOCUMENTS 3,429,390 A 2/1969 Bennett
3,493,165 A 2/1970 Schonfield
3,583,504 A 6/1971 Aalund
3,764,493 A 10/1973 Rosar
3,821,993 A 7/1974 Kniff
3,955,635 A 5/1976 Skidmore
3,960,223 A 6/1976 Kleine
RE29,300 E * 7/1977 Bender ..... 175/426
4,081,042 A 3/1978 Johnson
4,096,917 A 6/1978 Harris
4,098,363 A * 7/1978 Rohde et al. ..... 175/391
4,106,577 A 8/1978 Summer
4,176,723 A 12/1979 Arceneaux
4,211,508 A * 7/1980 Dill et al. ..... 407/120
4,253,533 A * 3/1981 Baker, III ..... 175/329
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,811,801 A * 3/1989 Salesky et al. ..... 175/433
4,852,672 A 8/1989 Behrens
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,435,401 A * 7/1995 Hedlund et al. ..... 175/296
5,507,357 A 4/1996 Hult
5,560,440 A 10/1996 Tibbitts
5,568,838 A * 10/1996 Struthers et al. ..... 175/246
5,655,614 A 8/1997 Azar
5,678,644 A 10/1997 Fielder
5,732,784 A 3/1998 Nelson
5,743,345 A * 4/1998 Hollar et al. ..... 175/401
5,794,728 A 8/1998 Palmberg
5,833,021 A * 11/1998 Mensa-Wilmot et al. .... 175/433
5,890,551 A * 4/1999 Liljebrand et al. ..... 175/418
5,896,938 A 4/1999 Moeny
5,947,215 A * 9/1999 Lundell ..... 175/417
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,035,953 A * 3/2000 Rear ..... 175/171
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine
6,340,064 B2 1/2002 Fielder
6,364,034 B1 4/2002 Schoeffler
6,394,200 B1 5/2002 Watson
6,439,326 B1 8/2002 Huang
6,474,425 B1 11/2002 Truax
6,484,825 B2 11/2002 Watson
6,502,650 B1 * 1/2003 Beccu ..... 175/296
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswani
6,953,096 B2 10/2005 Glenhill
6,971,458 B2 * 12/2005 Kriesels et al. ..... 175/339
7,225,886 B1 * 6/2007 Hall ..... 175/57
7,392,863 B2 * 7/2008 Bjork ..... 175/414
2001/0047890 A1 * 12/2001 Meyers et al. ..... 175/420.1
2002/0043407 A1 * 4/2002 Belnap et al. ..... 175/374
2003/0213621 A1 11/2003 Britten
2004/0040752 A1 * 3/2004 Brandenberg et al. .... 175/420.1
2004/0238221 A1 12/2004 Runia
2004/0256155 A1 12/2004 Kriesels
2005/0183892 A1 * 8/2005 Oldham et al. ..... 175/402
2006/0060389 A1 * 3/2006 Hadin et al. ..... 175/415
2006/0131075 A1 * 6/2006 Cruz ..... 175/57
2006/0266558 A1 * 11/2006 Middlemiss et al. ..... 175/426
2007/0039761 A1 * 2/2007 Cruz ..... 175/415
2007/0221417 A1 * 9/2007 Hall et al. ..... 175/415

* cited by examiner

PERCUSSIVE DRILL BIT

BACKGROUND OF THE INVENTION

Percussion drill bits are used in downhole drilling applications to percussively degrade a formation into which a drill string is boring. The object of this invention is to disclose a percussive drill bit which may allow the drill string to bore a straighter hole and which may last longer than percussion drill bits of the prior art.

U.S. Pat. No. 5,947,215, which is herein incorporated by reference for all that it contains, discloses a rock drill bit for percussive drilling including a steel body in which six gauge buttons and a single front button are mounted. The gauge buttons are arranged symmetrically and equally spaced about a central axis of the bit. The front button is arranged along the central axis. The front button is of larger diameter than the gauge buttons are diamond-enhanced, and the front button may be diamond enhanced.

U.S. Pat. No. 4,304,312, which is herein incorporated by reference for all that it contains, discloses a percussion drill bit comprising a bit body including a shaft having a conical mounting portion to be mated with a conical mounting portion of a drill rod by means of substantially longitudinal friction forces. An annular row of circumferentially spaced button inserts extend from a front face of the body. A central button insert is disposed centrally of the other inserts and extends axially from the front face of the body beyond the other inserts to define a pilot insert.

BRIEF SUMMARY OF THE INVENTION

In one aspect of the invention, a percussive drill bit has a working face opposite a shank end. The working face has a central jack insert and a plurality of peripheral inserts extending from the working face. The ends of the plurality of the peripheral inserts define an impacting plane. The plurality of peripheral inserts may be attached to a gauge. The central jack insert is disposed within a recessed portion of the working face and has an end extending between the working face and the impacting plane. The central jack insert may be bonded into a sleeve in a pocket formed in the recess. The central jack insert may comprise a diameter less than or equal to a diameter of at least one of the plurality of peripheral inserts.

A bit skirt may be located intermediate the working face and the shank end. The skirt may comprise a plurality of cutting elements. The skirt may comprise a length of about 0.25 to 6 inches. A radius of 0.25 to 2 inches may connect the skirt and shank.

At least one of the inserts may comprise a hard surface comprising a material selected from the group consisting of diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, and combinations thereof. At least one of the inserts may comprise a domed shape, rounded shape, semispherical shape, conical shape, or a combination thereof.

The recessed portion may be generally concave. The recessed portion may form a step. The recessed portion may comprise a plurality of peripheral inserts.

The working face may comprise a plurality of shear cutters. The plurality of shear cutters may be disposed within junk slots. The working face may comprise a first plurality of inserts comprising a material with a hardness of at least 63 HRc and a second plurality of inserts comprising a hardness of at least 2000 HV. The shank end may comprise a hard surface with a hardness of at least 63 HRc. The hard surface may be attached to a spline or a striking surface of the shank end. The working face may further comprise a washer disposed around the diameter of at least one of the inserts.

DETAILED DESCRIPTION OF THE INVENTION AND THE PREFERRED EMBODIMENT

Figure 1:
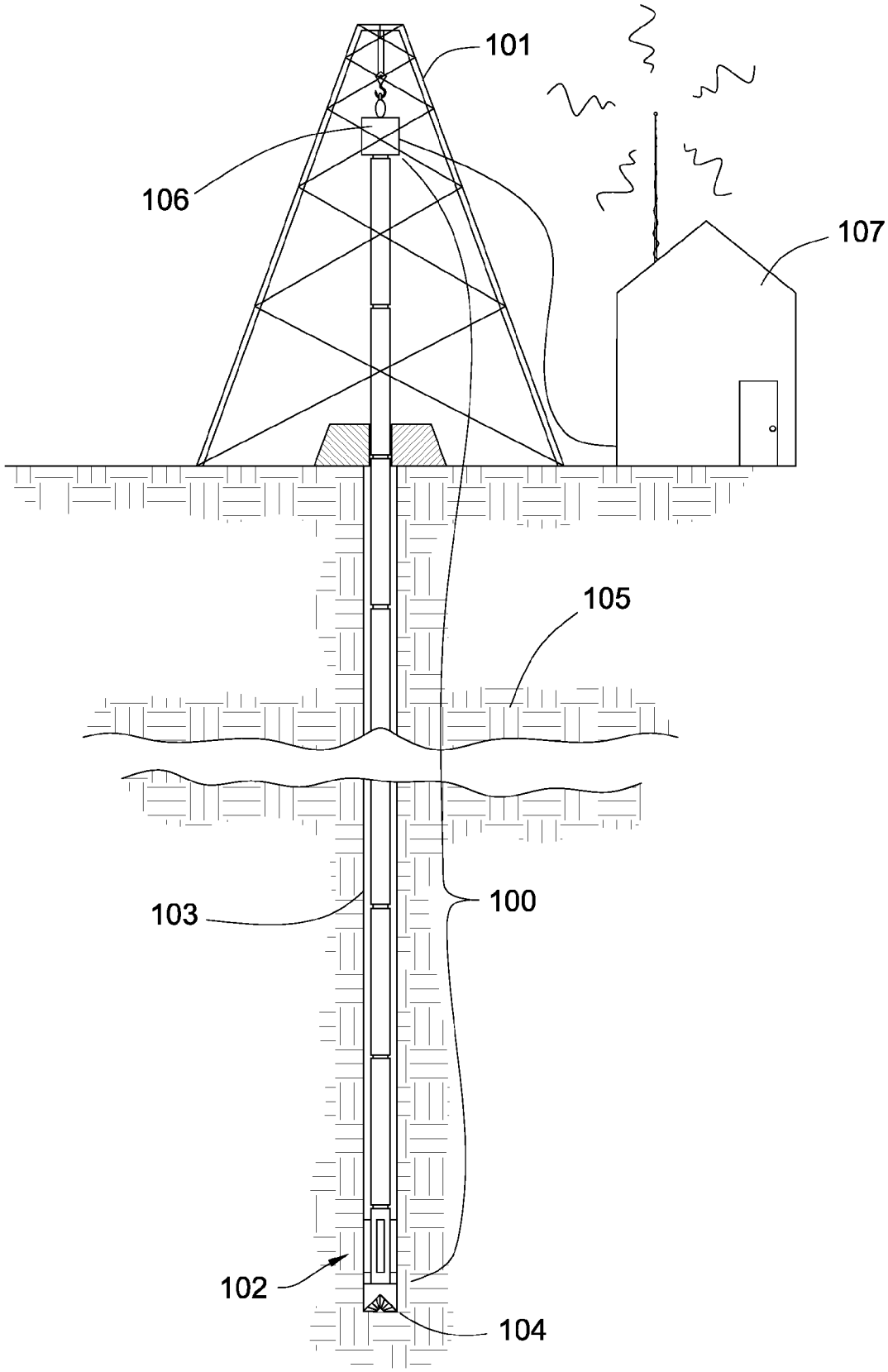
FIG. 1 is a perspective diagram of an embodiment of a drill string suspended in a bore hole.

FIG. 1 is an embodiment of a drill string 100 suspended by a derrick 101. A bottom-hole assembly 102 is located at the bottom of a bore hole 103 and comprises a drill bit 104. As the drill bit 104 rotates downhole the drill string 100 advances farther into the earth. The drill string may penetrate soft or hard formations. The bottom-hole assembly 102 and/or downhole components may comprise data acquisition devices which may gather data. The data may be sent to the surface via a transmission system to a data swivel 106. The data swivel 106 may send the data to the surface equipment 107. Further, the surface equipment 107 may send data and/or power to downhole tools and/or the bottom hole assembly 102.

Figure 2:
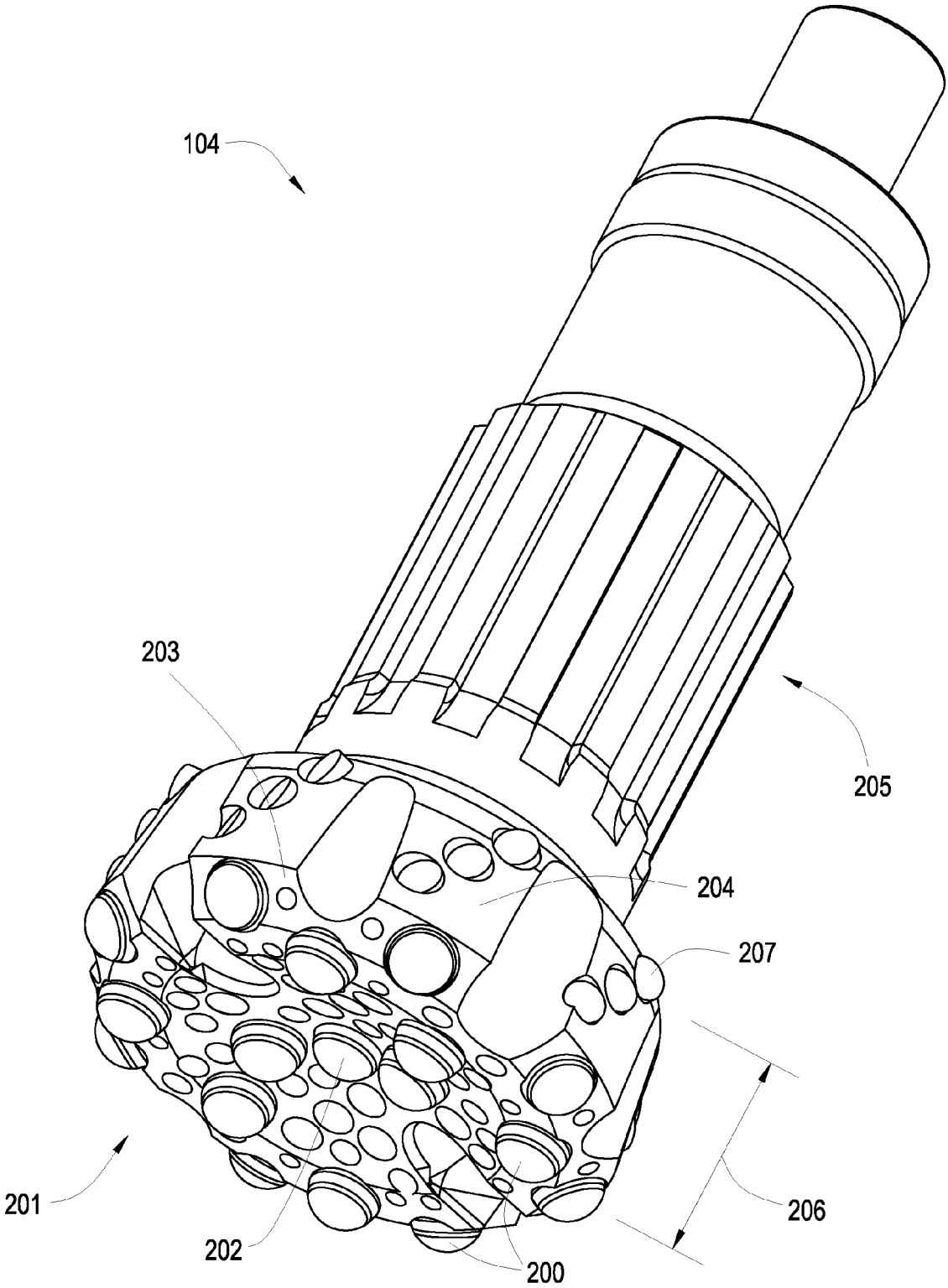
FIG. 2 is a perspective diagram of an embodiment of a percussion drill bit.

Referring now to FIG. 2, the drill bit shown is an embodiment of a percussive drill bit 104. The bit 104 comprises a working face 201 opposite a shank end 205. A plurality of peripheral inserts 200 extend from the working face 201 of the bit 104, with a central jack insert 202 also disposed within and extending from the face 201. A portion of the plurality of peripheral inserts 200 may be attached to a gauge 203 on the working face 201. The drill bit 104 may comprise a bit skirt 204 located intermediate the working face 201 and the shank end 205. The skirt 204 may comprise a length 206 of about 0.25 to 6 inches. The skirt 204 may also comprise a plurality of cutting elements 207 positioned such that as the percussion bit 104 is in operation, the cutting elements 207 may aid in reducing the amount of torque on the shank end 205 of the bit 104 produced from the rotation of the drill string 100 and bit 104.

The inserts 200, 202 may comprise a hard surface comprising a material selected from the group consisting of diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, and combinations thereof. The hard surface may lengthen the useful drilling life of the inserts 200, 202 and the drill bit 104.

Figure 3:
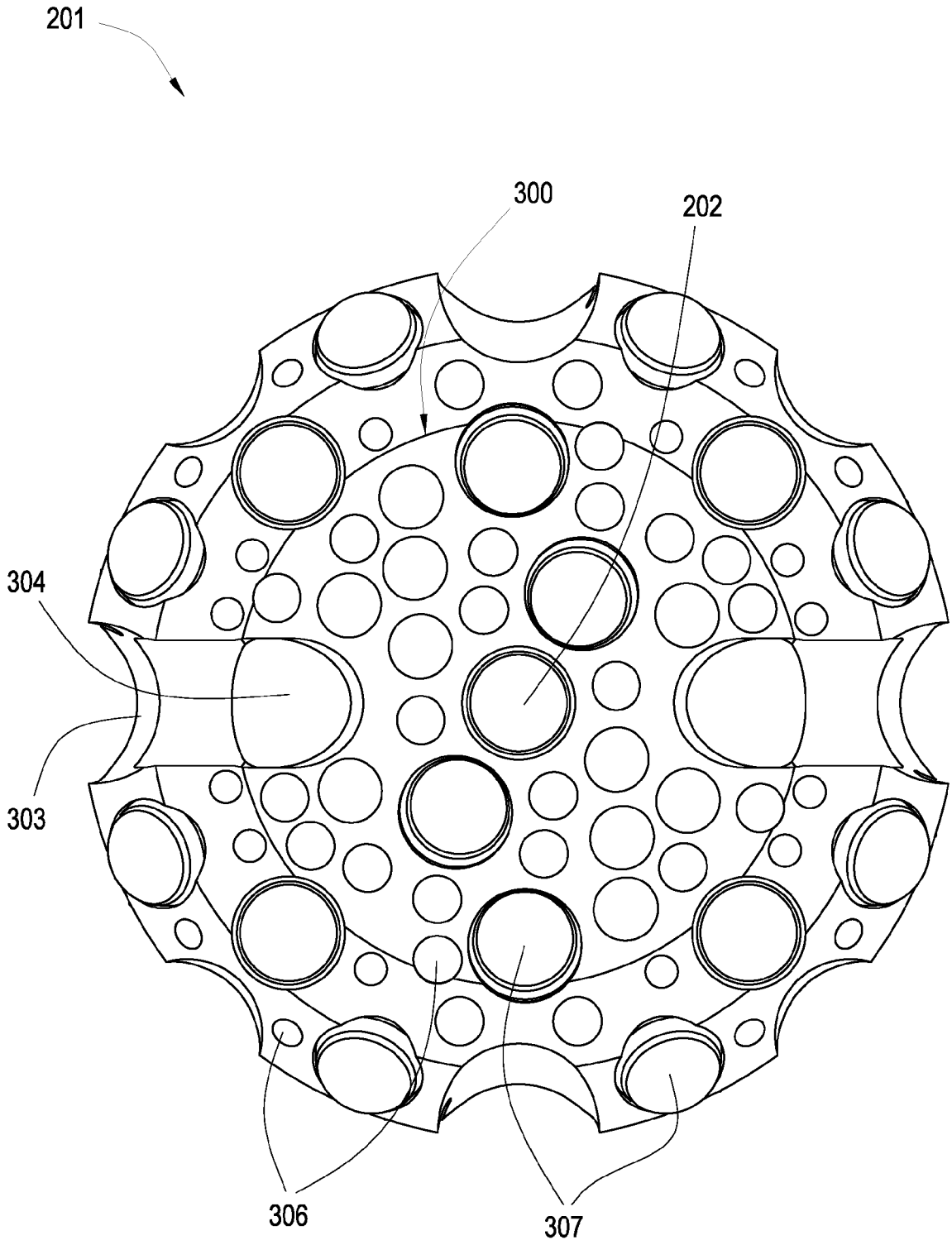
FIG. 3 is a bottom diagram of another embodiment of a percussion drill bit.

Referring to the embodiment of FIG. 3, the working face 201 comprises a recessed portion 300. A portion of the working face 201 may be flat while the recessed portion 300 may be generally concave. The recessed portion in the working face causes a raised portion (See No. 410 in FIG. 5) to be formed in the formation 105. The central jack insert 202, disposed within the recessed portion 300, may be concentric with an axis of rotation of the drill bit 104. The recessed portion 300 may also comprise a plurality of peripheral inserts surrounding the central insert. The central jack insert 202 in the recessed portion 300 may provide rotational stability for the drill bit 104 and is believed to result in drilling a straighter hole 103. This may also result in faster, more efficient drilling.

The working face 201 may comprise junk slots 303 that allow for the working face 201 to shed downhole material from the formation 105 that has been previously crushed or otherwise dislodged. The working face 201 may also comprise at least one opening 304 connected through which a jet of fluid may be emitted. The fluid may be air or another fluid, such as drilling mud. The jet, in combination with the junk slots 303, may make the drill bit 104 more effective at penetrating the formation 105 by clearing away debris and crushed formation from the front of the working face 201. They may be especially useful in clearing away the raised portion of the formation 105 as it is continuously crushed.

The working face 201 may be made of a metal matrix composite or other materials such as steel alloy such as 4140, 4340, EN30B. The working face 201 may also comprise a coating of a material with a hardness of at least 63 HRc, such as tungsten carbide, cemented metal carbides, titanium, aluminum, tungsten, chromium, or combinations thereof. The coating may be bonded to the working face 201 by methods such as electroplating, electroless plating, cladding, hot dipping, galvanizing, or thermal spraying.

The working face 201 or skirt 204 may comprise inserts comprising different individual hardness values. A first plurality of inserts 306 may comprise a material with a hardness of at least 63 HRc and a second plurality of inserts 307 may comprise a material with a hardness of at least 2000 HK, such as diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide or combinations thereof. The first plurality of inserts 306 may be smaller in diameter than the second plurality of inserts 307. Providing the smaller inserts 306 may allow a larger portion of the area of the working face 201 to be protected by inserts 200. This may protect the working face 201 from degrading as quickly as it would without the variety of inserts 306, 307, and may be more cost-effective than providing more inserts 307 comprising the material of hardness of at least 2000 HK, which are typically more expensive. The inserts 306 may also allow for the raised portion of the formation 410 to be formed in the recessed portion 300 of the working face 201 more easily. The inserts may also comprise a generally circular shape, generally square shape, generally oval shape, generally rectangular shape, generally triangular shape, or combinations thereof.

Figure 4:
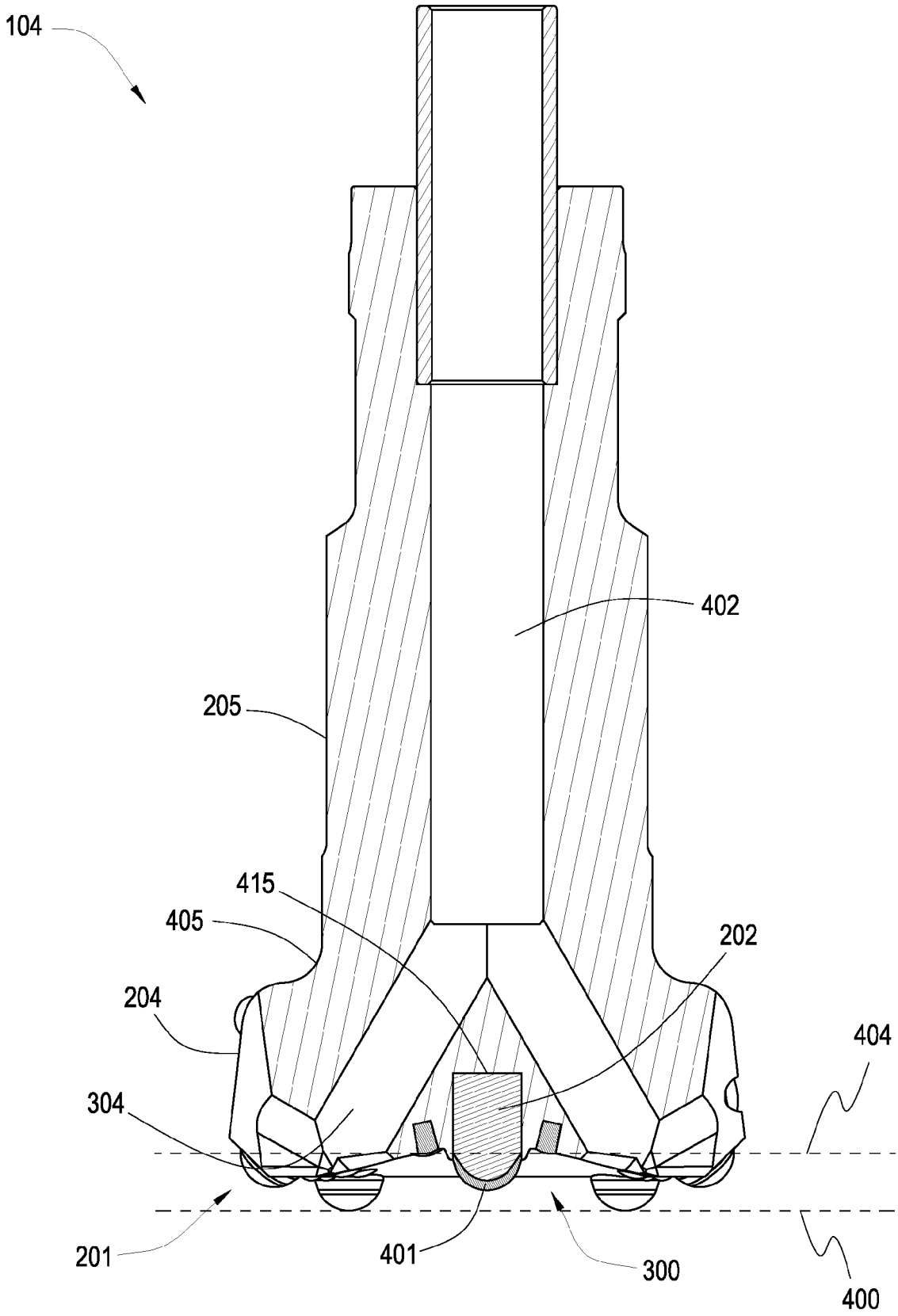
FIG. 4 is a cross-sectional diagram of another embodiment of a percussion drill bit.
Figure 5:
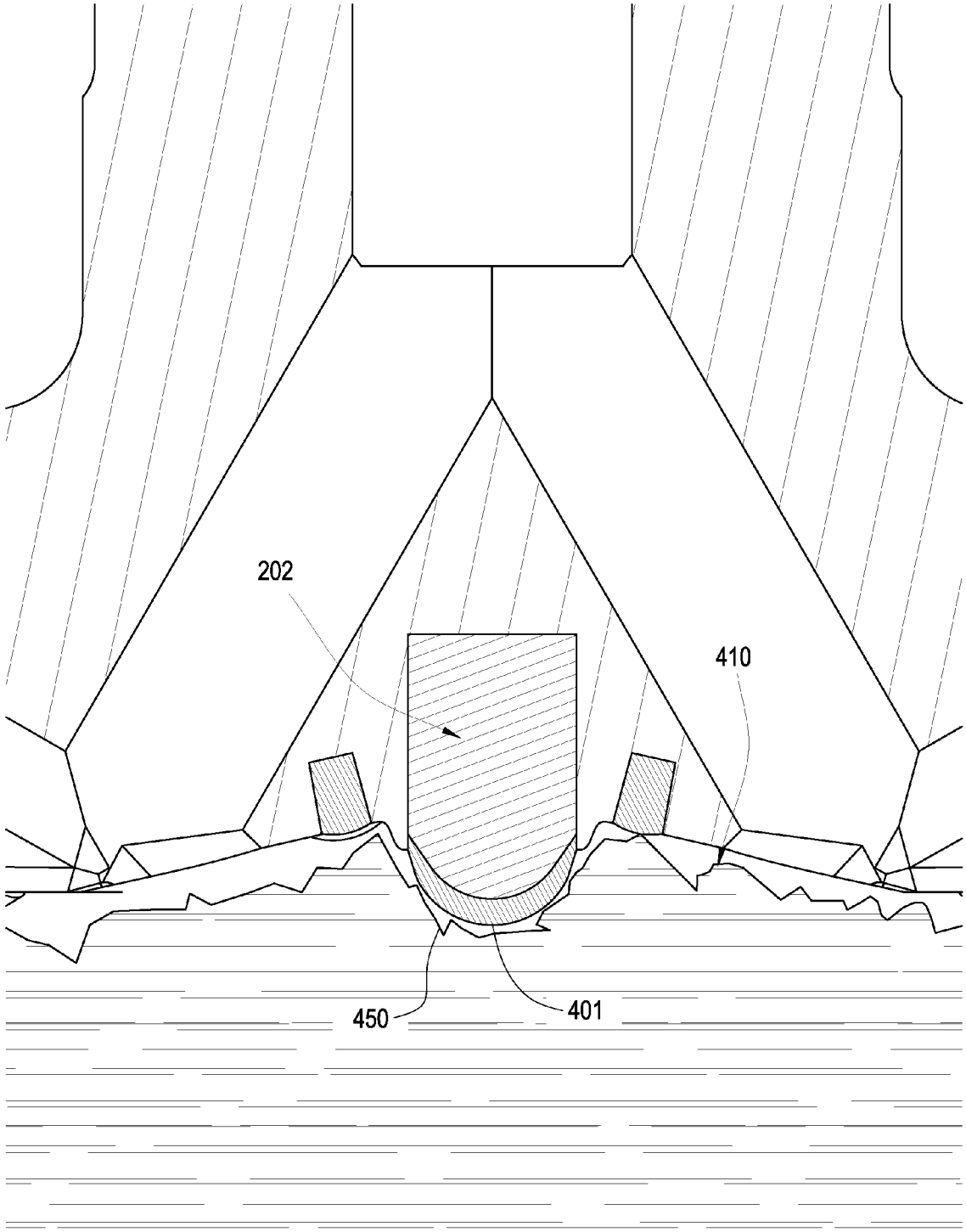
FIG. 5 is a cross-sectional diagram of another embodiment of a percussion drill bit.

Referring to the embodiments of FIG. 4 and FIG. 5, as the drill bit 104 rotates and impacts the formation 105, the raised portion 410 of the formation 105 is created. The central jack insert 202 indents into and compressively fails a central point of the raised portion 410, creating a crater 450 and pushing formation adjacent the central point outward towards the peripheral inserts. This action centers the rotation of the drill bit 104 about the central point and stabilizes the rotation of the drill bit 104 as it operates. The raised portion 410 of the formation 105, in addition to centering the drill bit 104 due to the interaction between the recessed portion 300 and the raised portion 410, is believed to also be crushed easier since the peripheral inserts have removed a portion of the formation surrounding the raised portion by the time central insert forms the crater. The plurality of peripheral inserts 200 in the recessed portion may crush the raised portion as a new raised portion 410 is continuously being created from the rotation of the bit 104 about the central point. The plurality of peripheral inserts 200 form an impacting plane 400 where the peripheral inserts 200 impact the formation 105.

It is believed that if the central insert extended to or beyond the impacting plane, that the compressive strength of the formation would be much higher than the compressive strength of the raised portion. This is because the raised portion may be dislodged laterally while the formation below the impacting plane resists flowing laterally since the peripheral inserts have not yet weakened the formation lateral to the formed crater. This increase of compressive strength is believed to lower the rate of penetration. While on the other hand, a central insert of the present invention which is capable of stabilizing the drill bit and also has an end terminating before the impacting plane formed by the peripheral inserts is capable of achieving higher rates of penetration due to the increased stability and weaker formations in front of the central portion of the drill bit.

The central jack insert 202 may be brazed or press fit into a pocket 415 in the working face 201. The central jack insert 202 may also be press fit into a sleeve in the pocket 415. The central jack insert 202 comprises an end 401 which extends to any position between a plane 404 extending from the working face 201 and the impacting plane 400. The openings 304 through which the jets of fluid may pass are connected to a bore 402 within the drill string 100.

The intersection 405 between the shank end 205 and the skirt 204 may be a radius of 0.25 to 2 inches. This type of a intersection 405 reduces stresses and prevents the skirt 204 from twisting off of the shank end 205 when a large amount of torque is exerted on the intersection 405 due to extremely hard formations 105 or due to the drill bit 104 getting caught in the formation 105.

Figure 6:
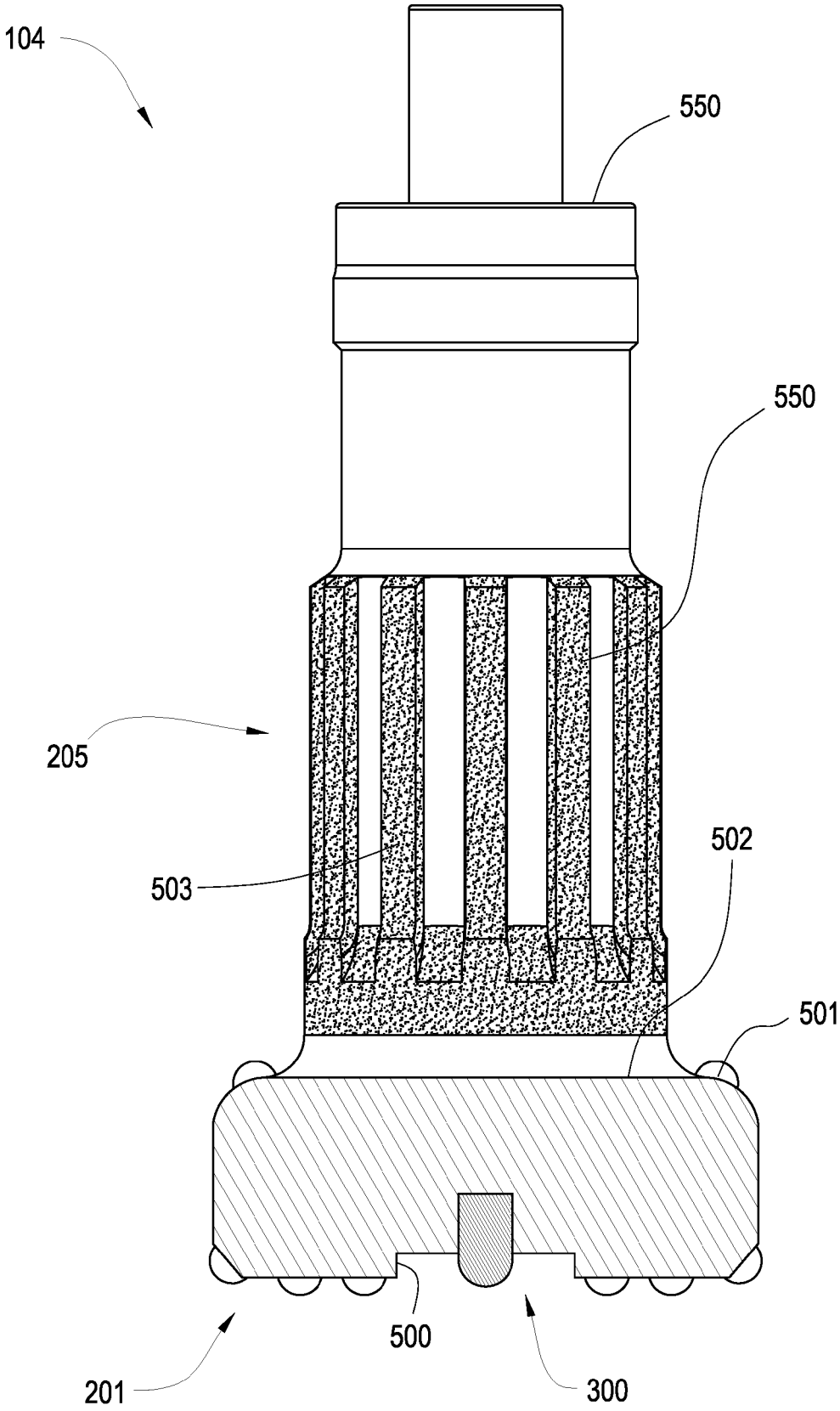
FIG. 6 is a sectional diagram of another embodiment of a percussion drill bit.

Referring now to the embodiment of FIG. 6, the working face 201 of the drill bit 104 may comprise a recessed portion 300 that forms a step 500. This embodiment is generally referred to in the industry as a drop center percussion bit 104. The drop center percussion bit 104 may be desirable for soft to medium formations 105. The bit 104 may also comprise a plurality of inserts 501 on an upper surface 502 opposite the working face 201 to prevent wear on the upper surface 502.

The shank end 205 may also comprise a hard surface 550 with a hardness of at least 63 HRc. The hard surface may be selected from the group consisting of chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bonded diamond, and combinations thereof. The hard surface 550 may be attached to a spline 503 or a striking surface of the shank end 205.

Figure 7:
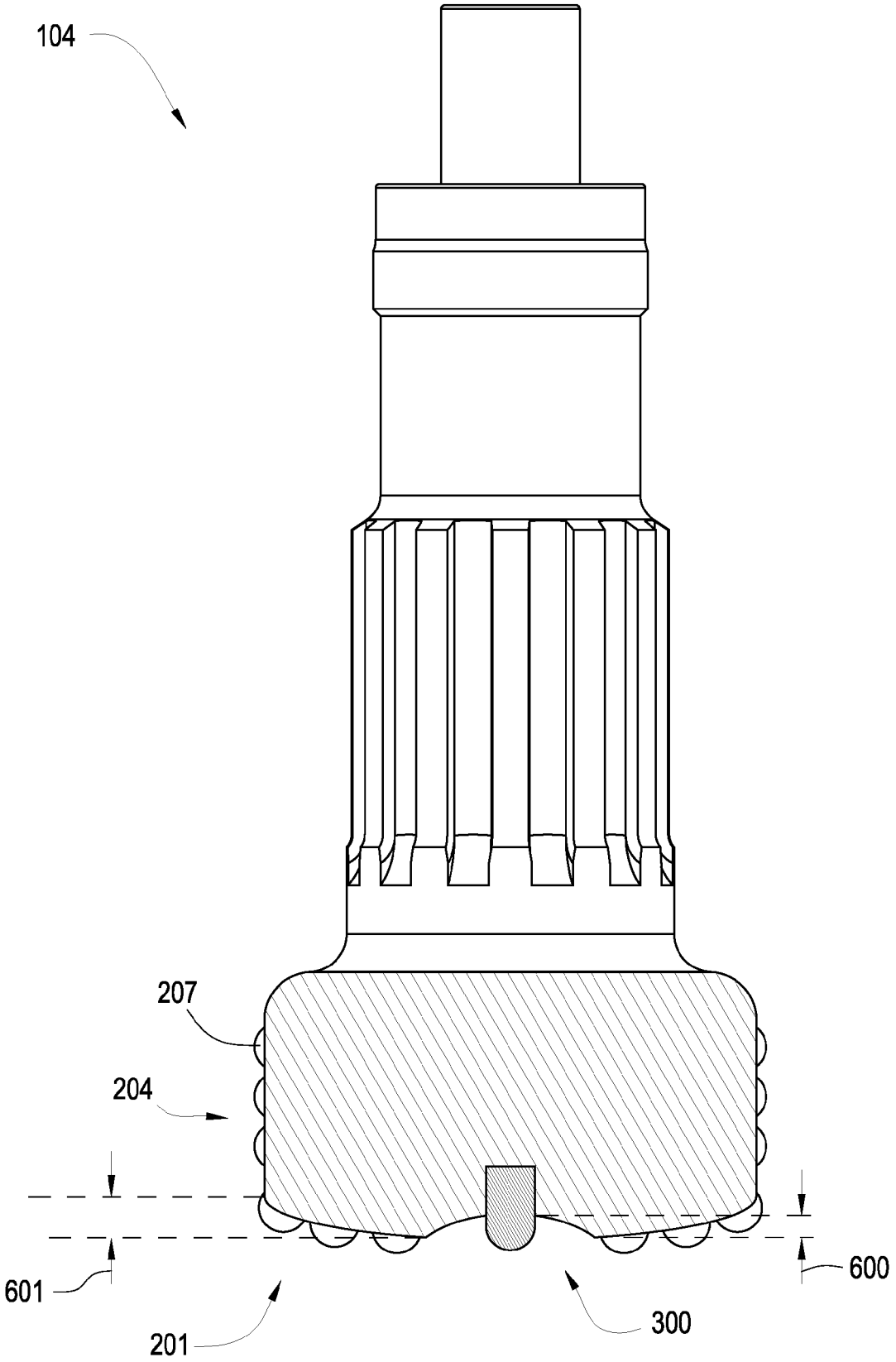
FIG. 7 is a sectional diagram of another embodiment of a percussion drill bit.

The drill bit 104 may also comprise a working face 201 that is substantially convex and comprises a recessed portion 300, as in the embodiment of FIG. 7. The recessed portion 300 may be substantially concave and may comprise a depth 600 less than or equal to a depth 601 of the convex working face 201. This embodiment comprises a longer skirt 204 and a plurality of shear cutters 207 on the skirt 204, the combination of which may be more useful in harder formations 105, as it may reduce the amount of torque on the bit 104.

Figure 8:
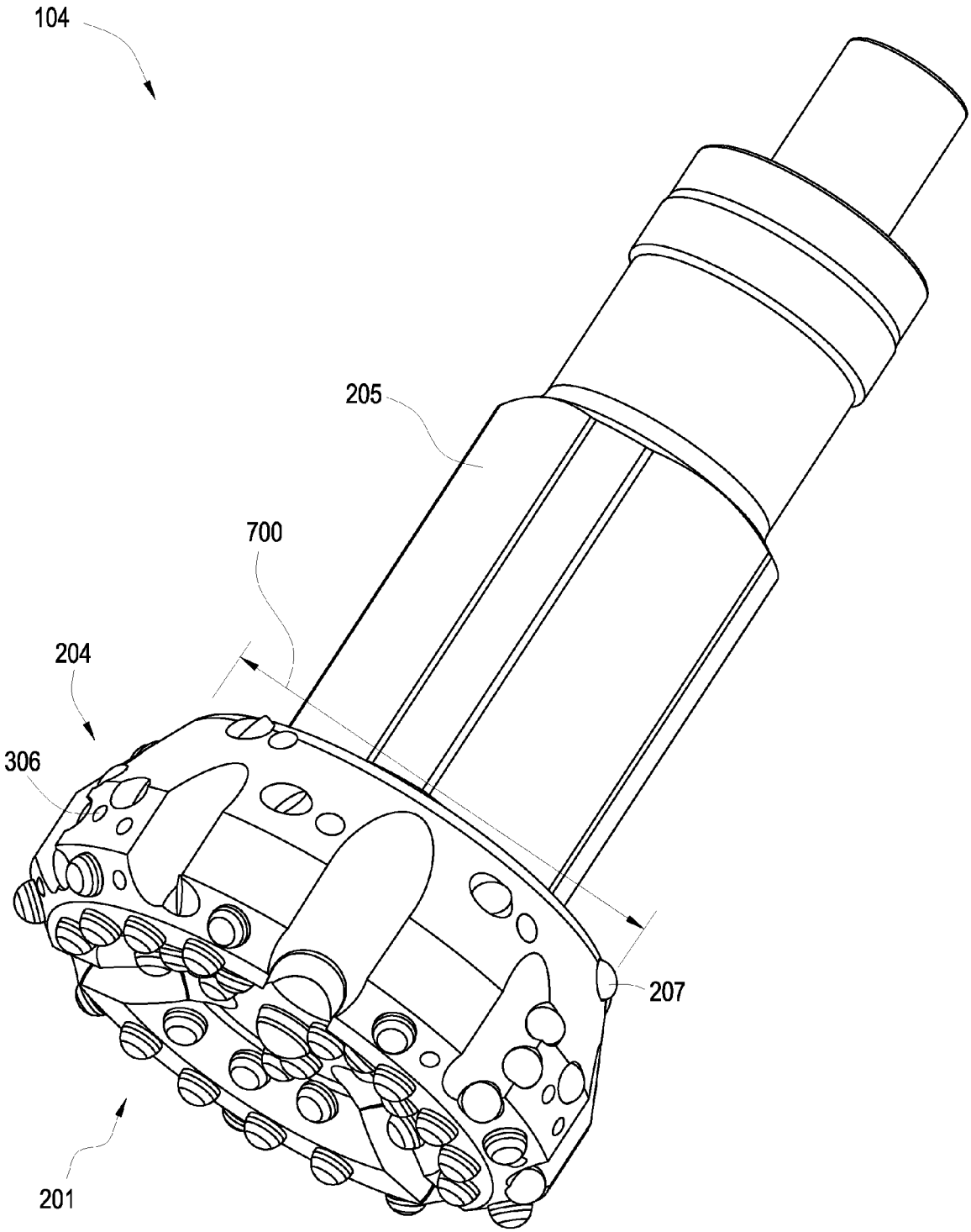
FIG. 8 is a perspective diagram of another embodiment of a percussion drill bit.

Referring now to FIG. 8, the bit skirt 204 may comprise a smaller diameter 700 closer to the shank end 205 of the drill bit 104 than at the working face 201. The skirt 204 may also comprise a plurality of shear cutters 207 and smaller inserts 306 which may clear away debris from the skirt 204 or protect the surface of the skirt 204.

The embodiment in FIG. 8 also comprises a shank end 205 which is polygonal shaped. The shank end 205 may be generally triangular, generally square, generally hexagonal, or other generally polygonal shapes. A polygonal shaped shank end 205 may reduce torque forces on the bit 104.

Figure 9:
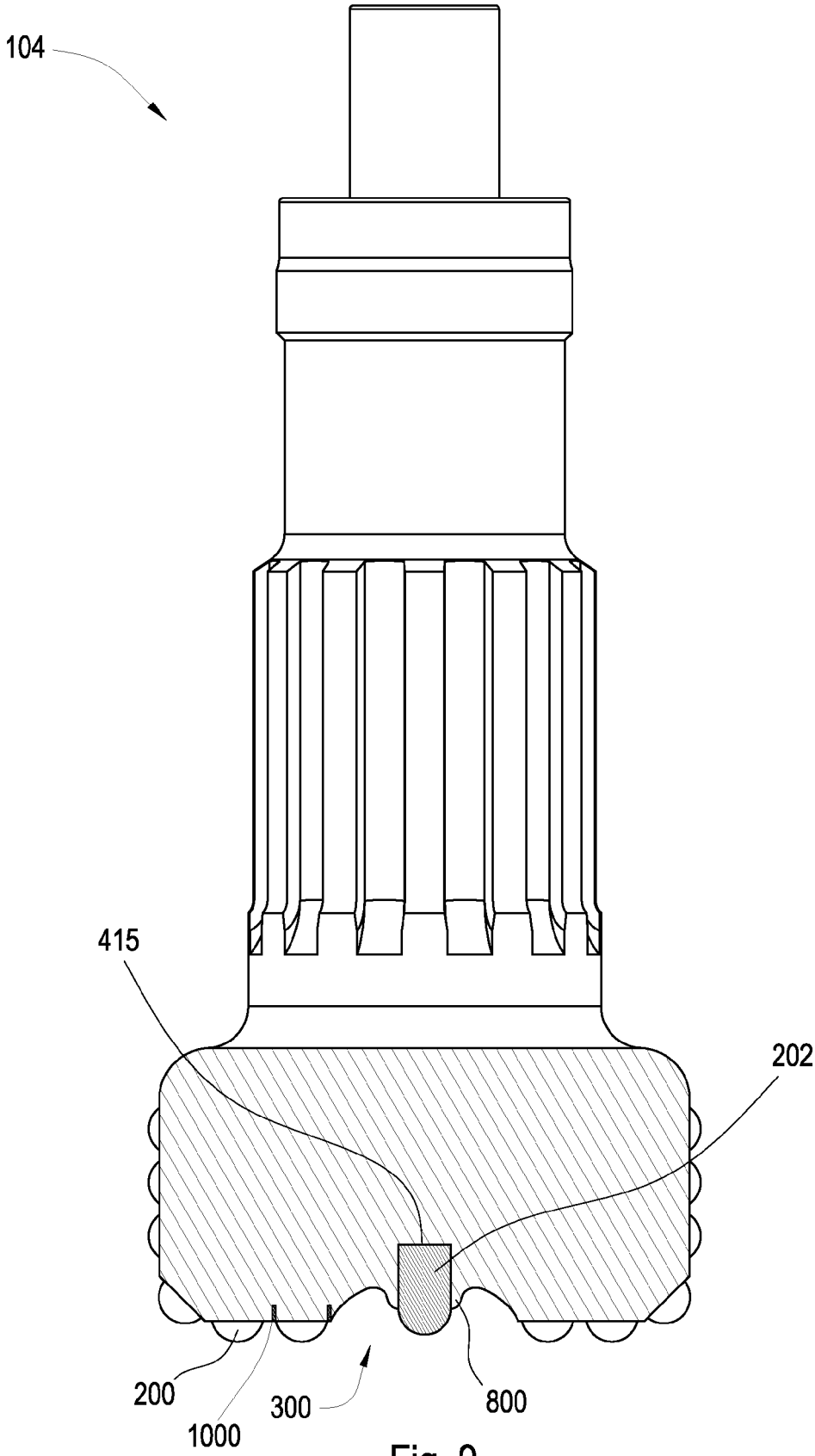
FIG. 9 is a sectional diagram of another embodiment of a percussion drill bit.

As in the embodiment of FIG. 9, the central jack insert 202 may be supported in the pocket 415 by a lip 800 formed in the recessed portion 300 of the bit 104. The lip 800 may provide additional support for the central jack insert 202, which may be useful since the central jack insert 202 may experience a large amount of loading or torque forces during operation. The central jack insert 202 may comprise any size diameter, but preferably less than or equal to a diameter of the peripheral inserts 200. The lip may be formed in the working face, or a ring may be bonded to the working face to provide the support.

Figure 10:
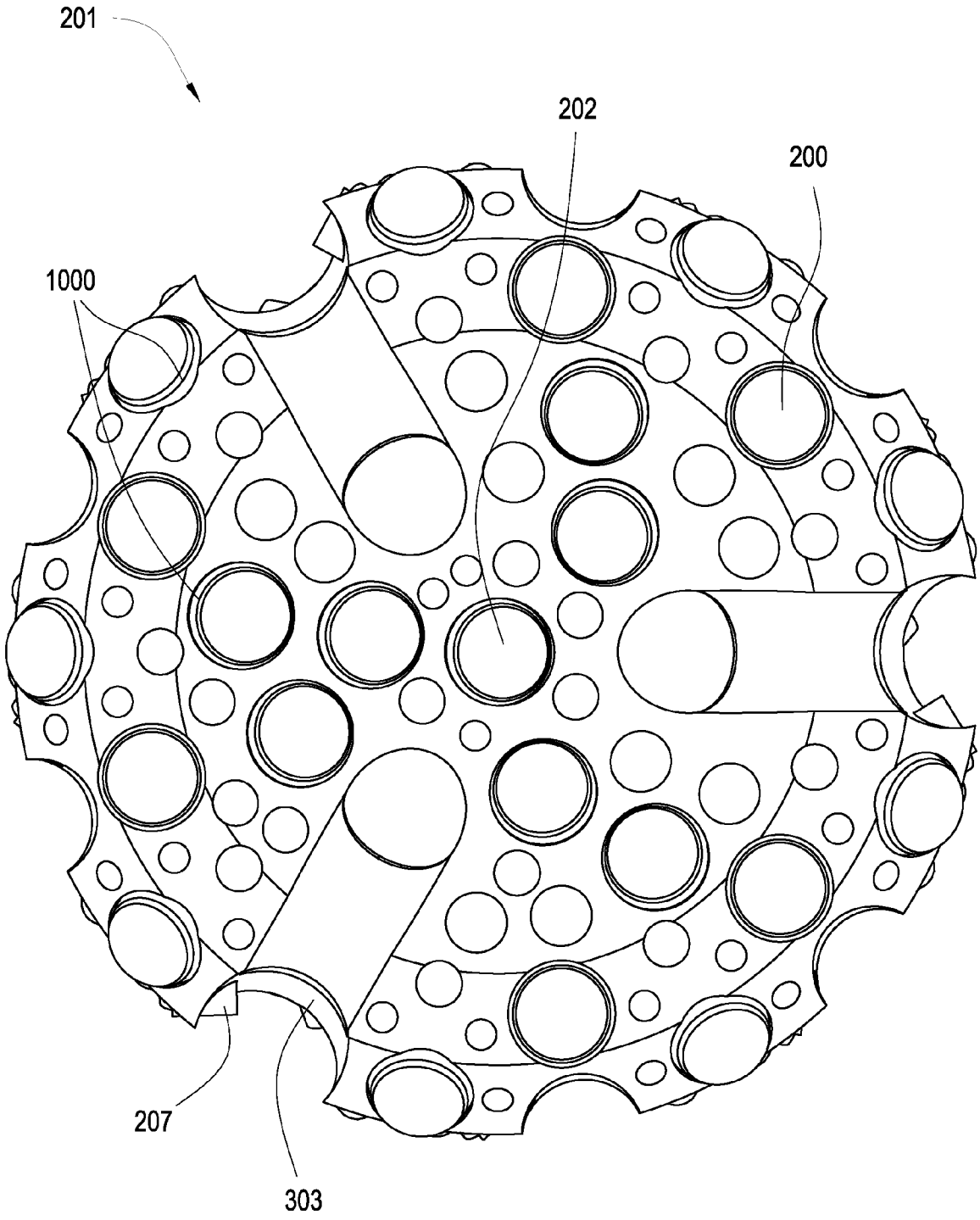
FIG. 10 is a bottom diagram of another embodiment of a percussion drill bit.

Referring now to FIG. 10, shear cutters 207 may be disposed within the junk slots 303. The shear cutters may reduce wear of the slots and aid in degrading the formation.

In some cases, the working face 201 may wear out around the inserts 200, 202 that are disposed within the working face 201, since the working face 201 is generally made of steel and is softer than the inserts. This wear may cause the inserts to be dislodged from their positions and fall out of the working face 201. In order to counteract the wearing of the working face 201, there may be a plurality of washers 1000 disposed around the inserts, as in the embodiment of FIG. 9. The washers 1000 may be made of a material of hardness of at least 63 HRc such as tungsten carbide. The washers 1000 may be disposed within circular recesses formed into the working face 201, or the washers 1000 may be brazed onto the surface 201 of the working face 201. The washers 1000 may extend upward at an angle above the surface 201 of the working face 201 in order to bolster the inserts.

The working face 201 may also comprise a coating of a material with a hardness of at least 63 HRc. The coating may be sufficient to protect the working face 201 from impacting forces of abrasive debris.

Figure 11:
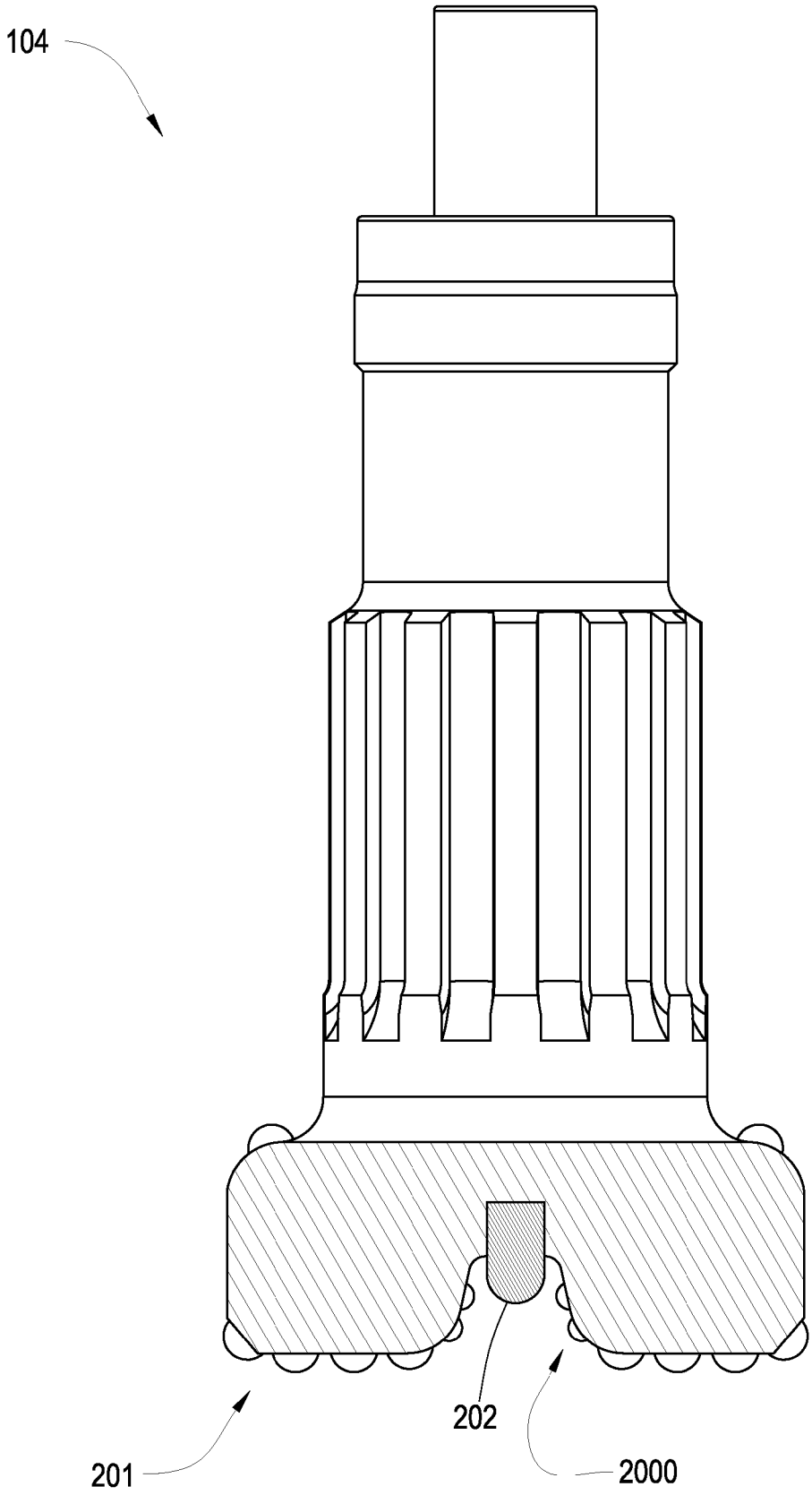
FIG. 11 is a sectional diagram of another embodiment of a percussion drill bit.
Figure 12:
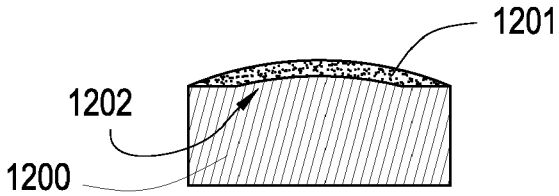
FIG. 12 is a cross-sectional diagram of an embodiment of an insert.
Figure 13:
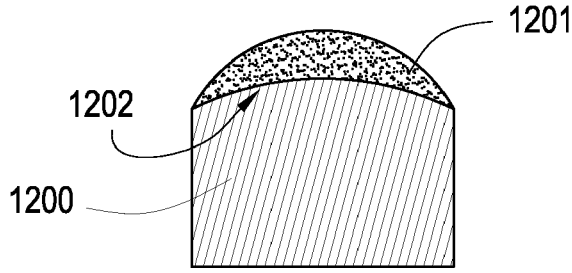
FIG. 13 is a cross-sectional diagram of another embodiment of an insert.
Figure 14:
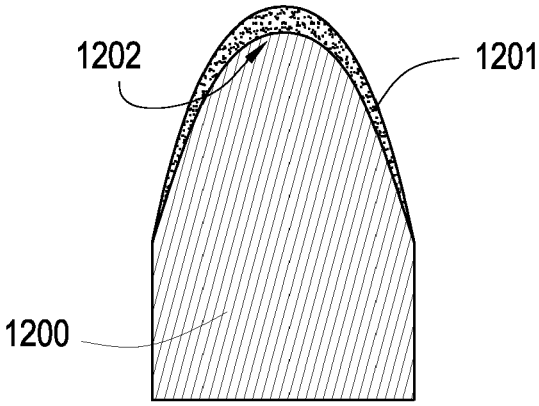
FIG. 14 is a cross-sectional diagram of another embodiment of an insert.
Figure 15:
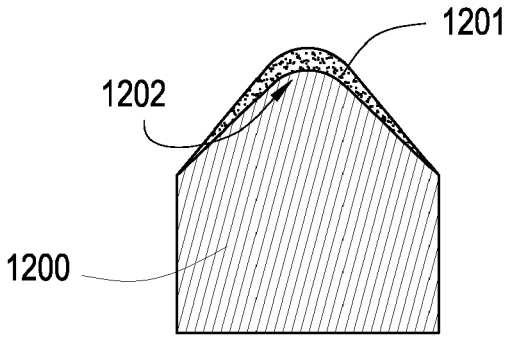
FIG. 15 is a cross-sectional diagram of another embodiment of an insert.
Figure 16:
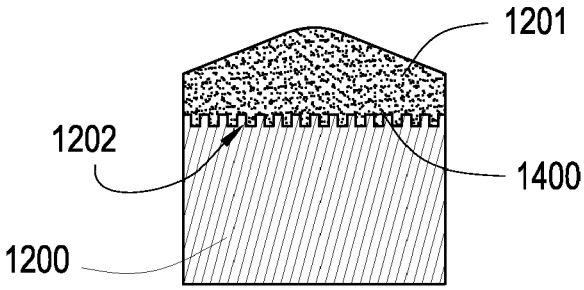
FIG. 16 is a cross-sectional diagram of another embodiment of an insert.
Figure 17:
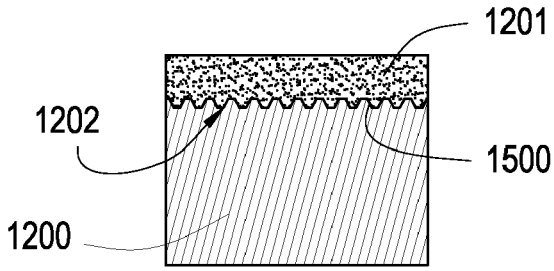
FIG. 17 is a cross-sectional diagram of another embodiment of an insert.

FIG. 11 discloses a bit 104 with a central jack insert 202 disposed within a recess 2000 formed in the working face 201. The recess 2000 may comprise a steep taper of 1 to 10 inches per inch. The recess may comprise multiple tapers within this range. In some embodiments an insert or cutter may be disposed within the recess 2000.

FIGS. 12-17 are embodiments of inserts which may be used in the present invention. The inserts preferably comprise a tungsten carbide body 1200 with a hard material 1201 bonded to an upper surface 1202 of the body. The material 1201 may be bonded by brazing. The hard material 1201 or the body 1200 may vary in thickness and shape. The inserts may comprise a domed shape, rounded shape, conical shape, flat shape, semispherical shape, or a combination thereof. The upper surface 1202 where the material 1201 is bonded may comprise grooves 1400 or ridges 1500, as in the embodiments of FIGS. 15 and 16.

Whereas the present invention has been described in particular relation to the drawings attached hereto, it should be understood that other and further modifications apart from those shown or suggested herein, may be made within the scope and spirit of the present invention.

What is claimed is:

1. A percussive drill bit comprising:

a working face opposite a shank end;

the working face comprising a central jack insert and a plurality of peripheral inserts extending from the working face, the central jack insert being concentric with an axis of rotation of the drill bit;

the ends of the plurality of peripheral inserts forming an impacting plane;

the central jack insert being disposed within a recessed portion of the working face and comprising an end extending between the working face and the impacting plane;

wherein a bit skirt is located intermediate the working face and the shank end and the skirt comprises a plurality of shearing elements, and wherein the central jack insert comprises a hardness greater than at least one of the peripheral inserts; and wherein the working face further comprises a washer of at least 63 HRc disposed around the diameter of at least one of the inserts, washer being disposed within a recess formed in the working face.

2. The bit of claim 1, wherein at least a portion of the plurality of peripheral inserts is attached to a gauge.

3. The bit of claim 1, wherein the skirt comprises a plurality of inserts comprising a hardness of at least 63 HRc.

4. The bit of claim 1, wherein the skirt comprises a length of about 0.25 to 6 inches.

5. The bit of claim 1, wherein a radius of 0.25 to 2 inches connects the skirt and shank.

6. The bit of claim 1, wherein the central jack insert is bonded to a pocket formed in the recess.

7. The bit of claim 1, wherein at least one of the inserts comprises a hard surface comprising a material selected from the group consisting of diamond, polycrystalline diamond, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, cemented metal carbide, chromium, titanium, aluminum, tungsten, and combinations thereof.

8. The bit of claim 1, wherein the recessed portion is generally concave.

9. The bit of claim 1, wherein the recessed portion forms a step.

10. The bit of claim 1, wherein the recessed portion comprises the plurality of peripheral inserts.

11. The bit of claim 1, wherein the recessed portion comprises a taper of 1 to 10 inches per inch.

12. The bit of claim 1, wherein at least one of the inserts selected from the group consisting of a domed shape, rounded shape, semispherical shape, conical shape, or a combination thereof.

13. The bit of claim 1, wherein the working face comprises a plurality of shear cutters.

14. The bit of claim 13, wherein the plurality of shear cutters are disposed on raised portions which form junk slots.

15. The bit of claim 1, wherein the working face comprises a first plurality of inserts comprising a material with a hardness of at least 63 HRc and a second plurality of inserts comprising a hardness of at least 2000 HK.

16. The bit of claim 1, wherein the working face comprises a coating of a material with a hardness of at least 63 HRc.

17. The bit of claim 1, wherein the shank end comprises a hard surface with a hardness of at least 63 HRc.

18. The bit of claim 17, wherein the hard surface is attached to a spline or a striking surface of the shank end.

19. The bit of claim 1, wherein the shank end is polygonal shaped.

20. The bit of claim 1, wherein the central jack insert comprises a diameter less than or equal to a diameter of at least one of the plurality of peripheral inserts.

21. The bit of claim 1, wherein the central jack insert is supported by a lip.

* * * * *